United States Patent [19]

Randolph

[11] Patent Number: 4,995,178

[45] Date of Patent: Feb. 26, 1991

[54] MACHINE FOR STRETCHING FABRIC OVER A PANEL FRAME

[76] Inventor: Travis M. Randolph, 276 W. 13th St., Holland, Mich. 49423

[21] Appl. No.: 409,159

[22] Filed: Sep. 19, 1989

[51] Int. Cl.[5] ..... D06C 3/00; D06C 3/08

[52] U.S. Cl. ..... 38/102; 38/102.1; 38/102.91

[58] Field of Search ..... 38/107.7, 102, 102.1–102.91, 38/103, 104, 106

[56] References Cited

U.S. PATENT DOCUMENTS

| | | | |
|---|---|---|---|
| 2,759,217 | 8/1956 | Peterson | 38/102.5 X |
| 3,315,301 | 4/1967 | Dibblee | 38/102.91 X |
| 3,414,994 | 12/1968 | Jaccard | 38/102.91 |
| 3,978,905 | 9/1976 | de Lama | 38/102.91 |
| 4,382,343 | 5/1983 | Chahanian | 38/102.91 |
| 4,555,377 | 11/1985 | Whiteside | 38/102.91 X |

*Primary Examiner*—Werner H. Schroeder
*Assistant Examiner*—Ismael Izaguirre
*Attorney, Agent, or Firm*—Waters & Morse

[57] ABSTRACT

A machine for stretching fabric over a panel frame has a surface for supporting the frame in a preferably horizontal position. The frame is usually rectangular, and sets of opposed jaws are arranged around the perimeter of the supported frame, with the jaws being interconnected by a pneumatic piston-cylinder actuator. One of the jaws is also connected to a second actuator, which induces downward movement of the jaws to stretch the grasped fabric over the panel frame. The latter actuators are energized by a common pressure source to equalize the tension on the opposite sides of the panel frame.

14 Claims, 5 Drawing Sheets

MACHINE FOR STRETCHING FABRIC OVER A PANEL FRAME

BACKGROUND OF THE INVENTION

The application of fabric to rectangular panel frames has become more important with the tremendous increase in the use of moveable partitions that define work areas. For decorative and sound-absorbing purposes, the usual panel structure is a rectangular frame of metal or wood, with a fabric stretched rather tightly over it. The fabric may be on one or both sides of the frame; and in the latter case, insulating material may be interposed. The fabric should be just tight enough so that it is not easily pinched together manually to form a ridge. Excessive or unbalanced stretching distorts the fabric, and this is not satisfactory at all with printed materials. Fabrics typically stretch with different modluli of elasticity along the length than they do across the width of the fabric roll. Equal tension in both directions thus induces greater extension in one direction than it does in the other. The usual rectangular panel also obviously will have greater fabric extension along the longer dimension, for equal application of force.

Various types of tightening devices have been developed for screen frames and similar units. These have typically involved sets of opposed jaws that grip the fabric, and then are moved laterally outward from the central area to produce the required tension in the fabric over the panel frame, followed by securing the fabric to the panel frame with staples or other fastening means. The Timphony U.S. Pat. No. 4,317,301 discusses a device that pulls the fabric around the edges of the panel frame, and toward the central area along the underside of the frame. The fabric is thus continuous along the top, edge, and bottom of the panel frame, and is stapled along any of these surfaces. Obviously, the amount of fabric required in this arrangement is a significant cost factor, and the interference of the jaws at the corners as they move inward can be a problem, if tension is to be applied along adjacent sides at the same time.

SUMMARY OF THE INVENTION

This fabric-stretching machine provides a horizontal supporting surface for a panel frame, and opposed jaws along one or more sections of the periphery of a supported frame. Preferably pneumatic piston-cylinder units interconnect the opposed jaws, with one jaw supporting the other through these actuators. The jaws receive the edges of a piece of fabric placed over the panel frame. One of the opposed jaws is carried by a second piston-cylinder actuator secured to the main frame of the machine in position to induce downward stretching movement of the jaws after they have grasped the fabric. The stretched fabric can then be stapled to the exposed edges of the panel frame. The pull-down cylinders, when jaws are placed on opposite sides of a panel frame, are energized by the same air pressure to equalize the tension.

DESCRIPTION OF THE PREFERRED EMBODIMENT

Figure 1:
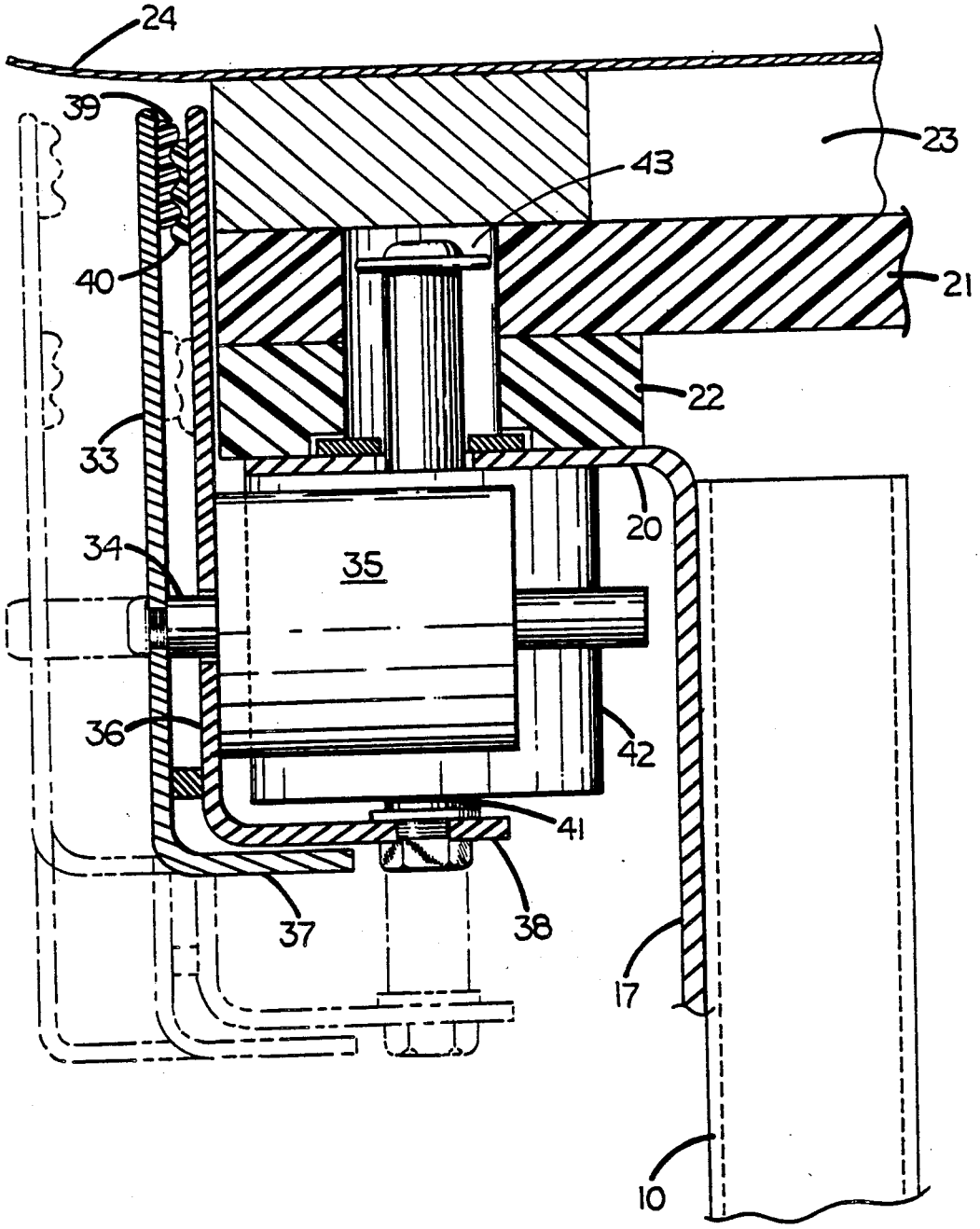
FIG. 1 is a sectional elevation along an edge of the machine showing the actuating mechanism for the jaws.

Referring to the drawings, the main frame is a table-like structure having the legs 10–13. A rectangular top configuration is formed by the angle members 14–17. The lower extremities of the end legs are interconnected by horizontal beams 18 and 19. These may be provided with standard height adjustment devices (not shown). The top peripheral flange 20 resulting from this structure provides a support for the platform 21 (refer to FIG. 2) having the peripheral spacing rail 22. The top surface of the platform 21 provides the supporting surface for a panel frame 23, which may be considered as a work piece to be processed by the machine. A sheet of fabric 24 is placed over the panel frame 23, and the function of the machine will be to grasp the edges of this fabric, and then pull the fabric downwardly along the edges of the panel frame to stretch the fabric to the desired tension.

Figure 2:
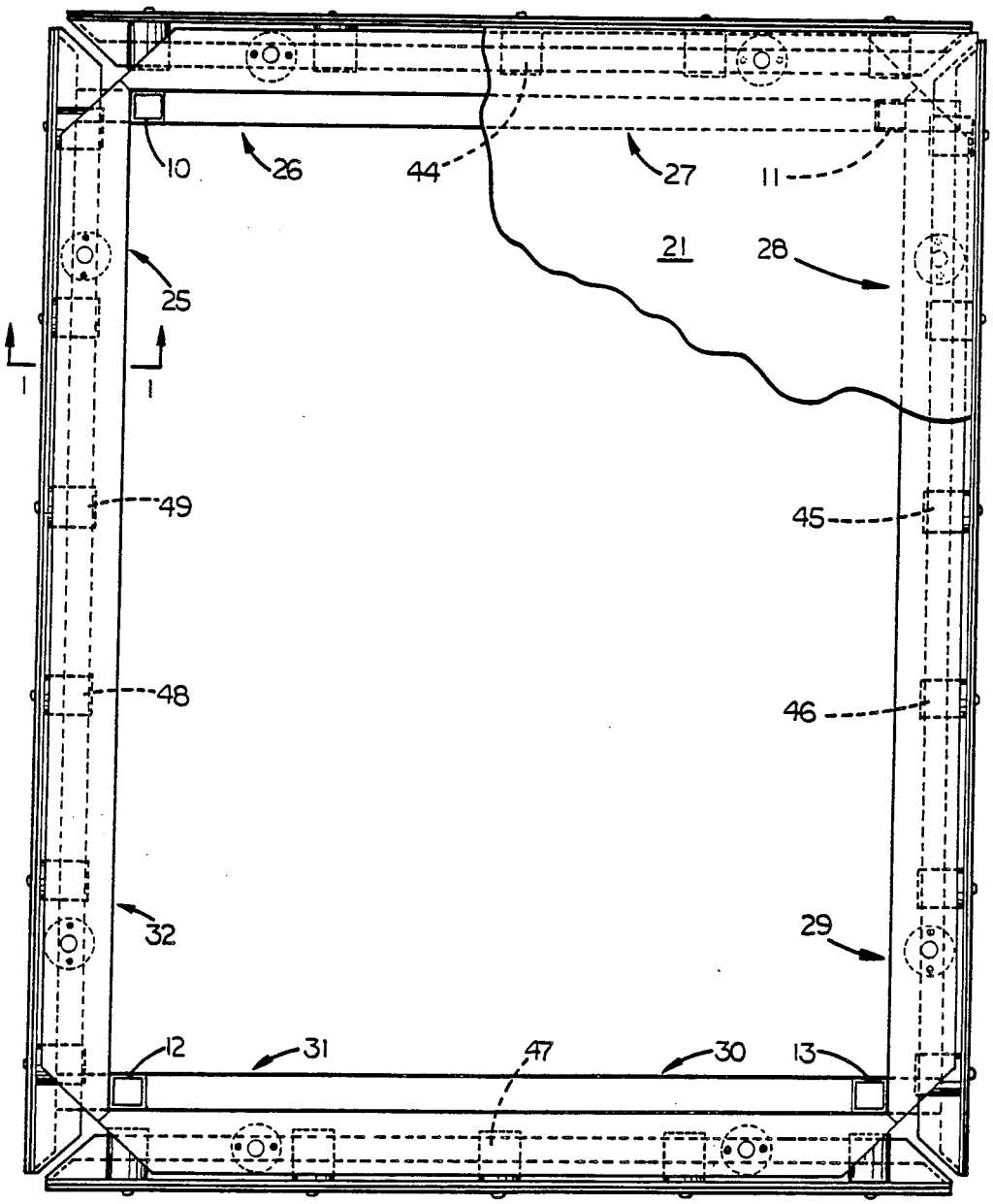
FIG. 2 is a top view of the machine, on a reduced scale.
Figure 3:
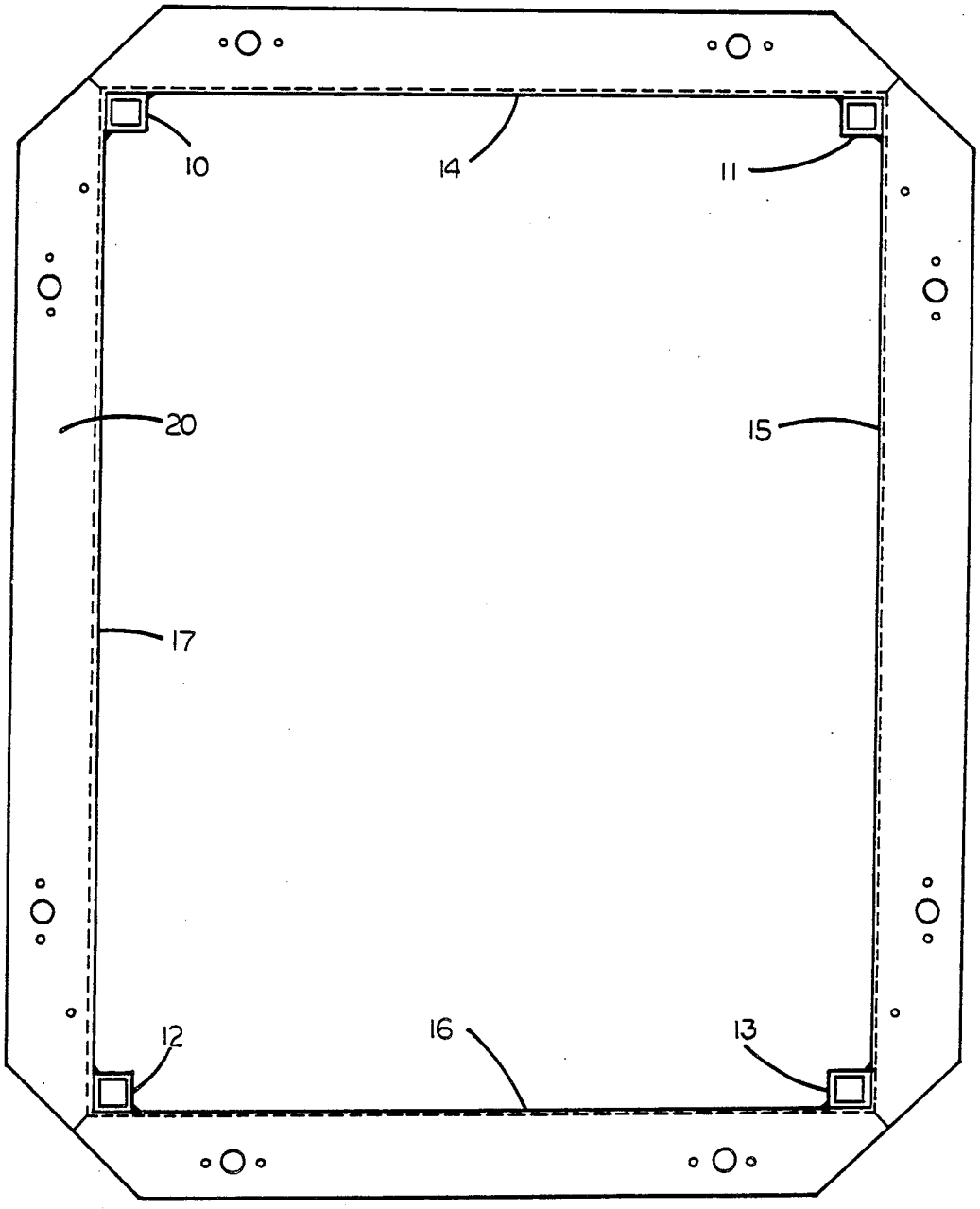
FIG. 3 is a top view of the main frame of the machine.
Figure 4:
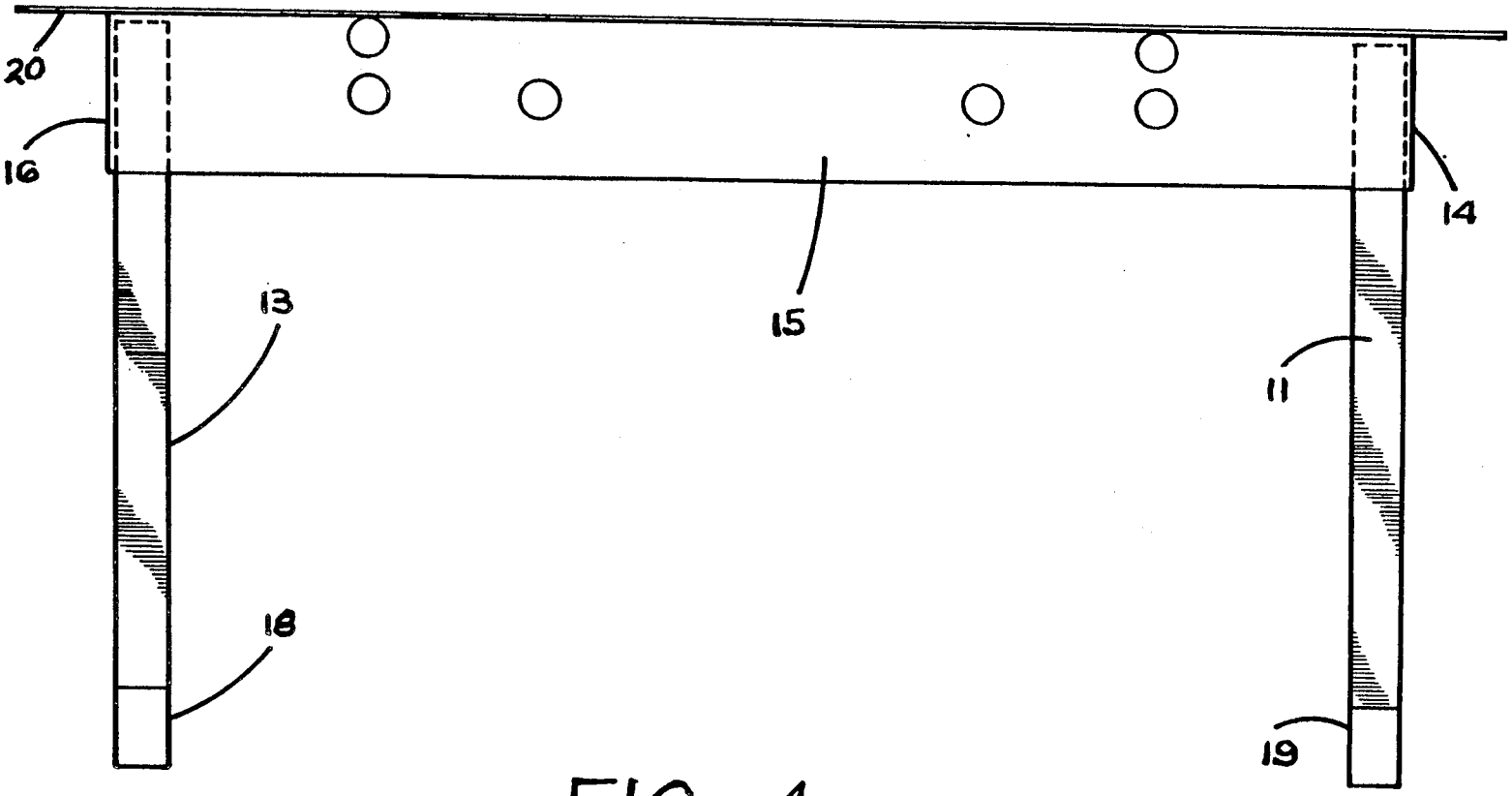
FIG. 4 is a side elevation of the main frame.
Figure 5:
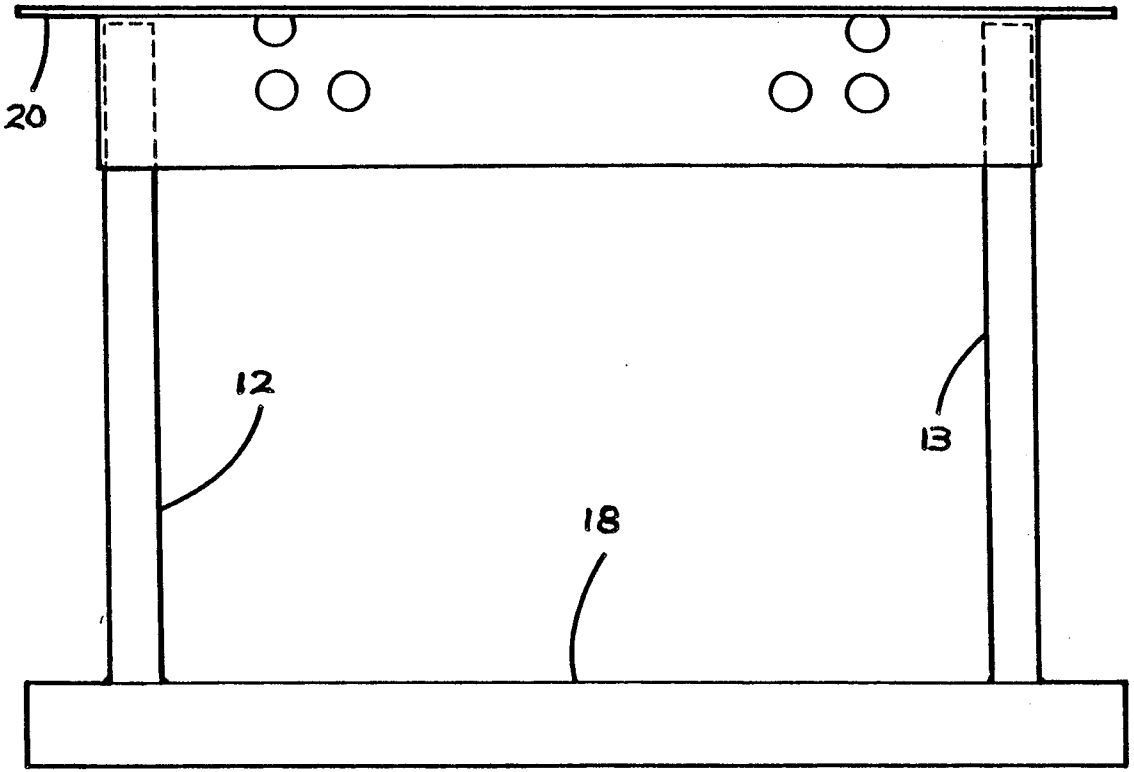
FIG. 5 is an end view of the main frame.

Referring to FIGS. 1 and 2, independent sets of opposed jaws are arranged along each of the four sides of the rectangular configuration provided by the platform 23. These are actuated between open and closed positions, and vertically by a combination of two pneumatic actuators arranged as shown at 25–32. Each pair of opposed jaws is provided with at least two of these combined actuators. They are all constructed as shown in FIG. 1. The outer jaw 33 is mounted on the piston rod 34 of the air cylinder 35 secured to the inner jaw 36. Both of these jaws are L-shaped in cross section, providing the lower stiffening flanges 37 and 38. The jaws also have pads as shown at 39 and 40 that interengage along a sinuous surface to provide the actual gripping surfaces engageable with the fabric 24. The lower flange 38 of the inner jaw is mounted on the piston rod 41 of the vertical actuator 42, which is secured to the flange 20 of the frame. The jaws are thus suspended from the actuators, which also establish the direction of movement in each case. Both of these actuators are preferably of the type in which the piston rod extends out both ends of the cylinder unit, and the upper end of the vertical actuator rod 41 moves within a clearance opening 43 in the structure of the platform 21 and its peripheral rail 22.

The operation of the machine is controlled by conventional electronic and pneumatic circuitry, preferably housed in a box (not shown) secured to the legs of the frame at one end of the machine. The operational cycle will normally be controlled entirely by this equipment, and initiated by manually pressing safety buttons that assure the position of the hands of the operator. The machine will normally be at rest with the jaws in the open position shown in dotted lines in FIG. 1. In this condition, the operator tucks the edge of the fabric 24 down between the jaws; and once this is done, the buttons of the machine are pushed to establish the normal cycle of operation. The jaws first close to the full line position shown in FIG. 1, through the action of the cylinders 35. After the jaws have securely closed, the vertical actuators 42 are provided with a source of pressure, moving the jaws to linearly traverse downward together to establish the necessary tension in the fabric 24. Preferably, the clamping actuators 35 are also positioned at other stations along the jaws to maintain the uniformity of clamping action, these being indicated in FIG. 2 at 44–49.

After the fabric has been properly stretched, the peripheral edges around the panel frame 23 are exposed for the reception of tacks or staples that secure the fabric semi-permanently in position. The downward movement of the jaws is sufficient to provide access for the application of the fastenings. The floating action provided by the application of equal air pressure to the stretching cylinders makes it possible to manually tilt the jaw system by applying downward force at a side or end to shift the fabric slightly into a more desirable position. This is very useful where the fabric has a dominant pattern. The effective automation of a formerly primarily manual stretching operation eliminates the need for highly paid craftsmen, and increases both quality and productivity.

I claim:

1. A fabric-stretching machine having a frame and means on said frame providing a supporting surface, and also having opposed jaws disposed along at least a portion of the periphery of said supporting surface, said jaws being movably mounted with respect to said frame, wherein the improvement comprises:

means for establishing a direction of linear traversing movement of said jaws in a direction substantially perpendicular to said supporting surface from a position displaced from said supporting surface to and from a position to further displacement therefrom; and means operable to open and close said jaws in a direction parallel to said supporting surface.

2. A machine as defined in claim 1, wherein said means operable to open and close said jaws is at least one piston-cylinder unit having the cylinder thereof secured to one of said jaws, and the piston secured to the other thereof, and said means for establishing a direction of linear traversing movement is at least one other piston-cylinder unit having one of the piston and cylinder thereof secured to said frame, and the other thereof secured to one of said jaws.

3. A machine as defined in claim 1, wherein said opposed jaws are disposed along each of opposite sides of said supporting surface, and said means establishing a direction of movement are supplied with equal fluid pressure.

4. A machine as defined in claim 1, wherein said means providing a supporting surface is rectangular, and said opposed jaws are disposed along each side thereof.

5. A machine as defined in claim 1, wherein said supporting surface is substantially horizontal, and said jaws are below the level thereof.

6. A machine as defined in claim 1, wherein said jaws are disposed laterally opposite to said frame.

7. A machine for mounting panel fabric on a multi-sided panel frame for a room divider partition comprising:

supporting means for supporting the panel frame in a generally horizontal position;

fabric clamp means mounted on the support means for releasably clamping and holding panel fabric around the periphery of the panel frame, the fabric clamp means comprising at least one separate elongated fabric clamp for each side of the panel frame, the fabric clamps extending adjacent and parallel to each side of the panel frame, each fabric clamp being openable to receive panel fabric therein and closeable to hold the panel fabric;

separate, movable mounting means for the fabric clamps on at least two adjacent sides of the panel frame, the mounting means guiding the movement of the fabric clamps in a downward direction to stretch the panel fabric over the panel frame, the clamps being movable downwardly a sufficient distance that the fabric can be fastened around the outer periphery of the panel frame;

clamp drive means for non-manually opening and closing the fabric clamps; and fluid drive means for simultaneously moving the individual movable fabric claps downwardly to stretch the fabric over the frame, the fluid drive means applying the same downward fluid pressure to all movable fabric clamps but permitting individual movement of the fabric clamps on adjacent sides for different distances, such that the fabric is stretched over all sides of the panel with uniform pressure even though the fabric may stretch more over one side than another.

8. A panel fabric mounting machine according to claim 7 and further comprising actuatable automatic control means for sequentially actuating the clamp drive means to close the clamps on the fabric and then activating the fluid drive means to move the clamps downwardly to stretch the fabric over the panel, permitting the stretched fabric to be fastened to the panel and thereafter actuating the clamp drive means to open the clamps so that the panel frame and fabric thereon can be removed from the apparatus.

9. A panel fabric mounting machine according to claim 7, wherein each fabric clamp comprises opposed elongated plates extending parallel to the outer edges of the panel frame for substantially the length of each side of the frame, the plates having slip resistant surfaces on opposing interior surfaces thereof that grip substantially the entire length of the fabric on each side of the panel frame when the plates are closed together, the mounting means mounting the plates for movement toward and away from each other, the plates and the clamp drive means being movably mounted on the clamp mounting means, such that the clamp drive means and clamp plates are moved downwardly together by the fluid drive means.

10. A panel fabric mounting machine according to claim 9, wherein the fabric clamp has one pair of plates on each side of the panel frame, the slip resistant surfaces comprising pads extending along the plates, with the pads on opposed plates having irregular mating contours that lock the fabric therebetween.

11. A panel fabric mounting machine according to claim 9, wherein the panel frame is rectangular, with one side of the rectangle being longer than the adjacent side, the fluid drive means being a plurality of fluid operated cylinders that are sized and positioned to maintain equal pressure along unequal lengths of panel fabric on the adjacent sides of the panel.

12. A panel fabric mounting machine according to claim 7 wherein the panel frame is rectangular and the fabric clamp means comprises a pair of vertically oriented spaced plates mounted along each peripheral side of the panel frame and positioned outwardly from the outer edges of the panel, the plates on each side of the panel frame extending substantially the entire length of the side of the panel frame and being mounted by the mounting means for linear vertical movement in a downward direction to stretch the fabric on the panel.

13. A panel fabric mounting machine according to claim 7, wherein the panel frame is supported on top of the support means and the moveable fabric clamp means extend to an upper position above the support means and adjacent an upper surface of the panel at the periphery thereof, the fabric clamps being moved downwardly below the top surface of the panel so as to expose the outer edge of the panel for fastening the fabric thereto when the fluid drive means is actuated.

14. A machine for mounting panel fabric on a rectangular panel frame for a room divider partition comprising:

support means for supporting the panel frame in a generally horizontal position;

fabric clamp means mounted on the support means for releasably clamping and holding panel fabric at the periphery of the panel frame, the fabric clamp means comprising separate elongated fabric clamps for each of the respective sides of the panel frame, each fabric clamp comprising elongated, spaced plates extending adjacent and parallel to each side of the panel frame for substantially the entire length of the panel frame, each fabric clamp being openable to receive panel fabric therein and closeable to hold the panel fabric;

separate, movable mounting means for the fabric clamps on at least two adjacent sides of the panel frame, the mounting means guiding the movement of the fabric clamp to stretch the panel fabric over the panel frame, the clamps permitting the fabric to be fastened to the outer periphery of the panel;

clamp drive means for opening and closing the fabric clamps;

fluid drive means for simultaneously moving the individual movable fabric clamps to stretch the fabric over the frame, the fluid drive means causing equal pressure to be applied to all moveable fabric clamps but permitting individual movement of the fabric clamps on adjacent sides for different distances, such that the fabric is stretched over all sides of the panel with uniform pressure even though the fabric may stretch more over one side than another; and actuatable control means for actuating the clamp drive means to close the clamps on the fabric and for actuating the fluid drive means to move the clamps to stretch the fabric over the panel, permitting the stretched fabric to be fastened to the panel and thereafter actuating the clamp drive means to open the clamps so that the panel frame and fabric thereon can be removed from the apparatus.

* * * * *

UNITED STATES PATENT AND TRADEMARK OFFICE

CERTIFICATE OF CORRECTION

PATENT NO. : 4,995,178

DATED : 02-26-91

INVENTOR(S) : Travis M. Randolph

It is certified that error appears in the above-identified patent and that said Letters Patent is hereby corrected as shown below:

Column 3, claim 1, line 27, delete "to" and substitute --of--;

claim 3, line 40, delete the numeral "1" in the the phrase "as defined in claim 1" and substitute the numeral --2--;

claim 7, line 57, delete the first occurrence of "supporting" and substitute --support--;

Column 4, claim 7, line 12, delete "claps" and substitute --clamps--.

Signed and Sealed this

First Day of September, 1992

*Attest:*

DOUGLAS B. COMER

*Attesting Officer*

*Acting Commissioner of Patents and Trademarks*